US008783460B1

(12) United States Patent
Citro

(10) Patent No.: US 8,783,460 B1
(45) Date of Patent: Jul. 22, 2014

(54) HAIR BOW CARRYING CASE

(71) Applicant: Donna Citro, Spotswood, NJ (US)

(72) Inventor: Donna Citro, Spotswood, NJ (US)

( * ) Notice: Subject to any disclaimer, the term of this patent is extended or adjusted under 35 U.S.C. 154(b) by 0 days.

(21) Appl. No.: 14/165,802

(22) Filed: Jan. 28, 2014

Related U.S. Application Data

(60) Provisional application No. 61/765,094, filed on Feb. 15, 2013.

(51) Int. Cl.
*B65D 73/00* (2006.01)

(52) U.S. Cl.
USPC ..... 206/457

(58) Field of Classification Search
USPC ..... 206/457, 6.1; 220/4.21, 4.22, 4.23, 220/4.24; 53/449, 167
See application file for complete search history.

(56) References Cited

U.S. PATENT DOCUMENTS

| | | | | |
|---|---|---|---|---|
| 4,887,751 | A | 12/1989 | Lehman | |
| 4,936,463 | A | 6/1990 | Tiramani | |
| 5,031,758 | A * | 7/1991 | Gonzalez | 206/6.1 |
| 5,056,660 | A * | 10/1991 | Huang | 206/232 |
| 5,452,806 | A * | 9/1995 | Campas | 211/85.2 |
| 5,842,562 | A * | 12/1998 | Bauman | 206/6.1 |
| 6,202,851 | B1 | 3/2001 | Walker | |
| D454,412 | S | 3/2002 | Riley | |
| 6,422,388 | B1 * | 7/2002 | McCahey | 206/457 |
| 6,446,688 | B1 | 9/2002 | Sutton | |
| 6,523,653 | B2 | 2/2003 | Roegner | |
| D655,507 | S | 3/2012 | Alcorn et al. | |
| 2004/0226846 | A1 * | 11/2004 | Rake et al. | 206/457 |
| 2009/0032044 | A1 * | 2/2009 | Grimm | 132/200 |
| 2013/0256173 | A1 * | 10/2013 | Sabbah | 206/457 |

* cited by examiner

*Primary Examiner* — Jacob K Ackun
(74) *Attorney, Agent, or Firm* — Goldstein Law Offices, P.C.

(57) ABSTRACT

A hair bow carrying case for securely transporting a cheerleader's ornamental hair bow, protecting the hair bow from being crushed or wrinkled. The bow is elastically secured in an upper compartment, coupling to a dividing partition. A plurality of necessary accessories for affixing the bow is stored in a lower compartment, the carrying case providing a complete solution for transportation of the bow and the accessories. The carrying case has a rigid shell operative for protecting the delicate bow.

19 Claims, 4 Drawing Sheets

HAIR BOW CARRYING CASE

CROSS-REFERENCE TO RELATED APPLICATIONS

This application is a nonprovisional utility application of the provisional patent application Ser. No. 61/765,094 filed in the United States Patent Office on Feb. 15, 2013 and claims the priority thereof and is expressly incorporated herein by reference in its entirety.

TECHNICAL FIELD

The present disclosure relates generally to a carrying case. More particularly, the present disclosure relates to a carrying case for an ornamental bow, such as a cheerleader's hair bow.

BACKGROUND

Competitive cheerleading is rapidly growing sport for girls and young women. Competitive cheerleading is not about being on the sidelines, rooting for a team. Competitive cheerleading is an intense, athletic performance combining dance, gymnastics and style. National associations host competitions all over the country. Cheerleading teams travel to regional events and move on to national events.

Competitive cheerleading involves intensive training and teamwork. The girls and young women exhibit tremendous skill and athleticism.

As important as the training and practice is to performance at competitive events, appearance plays a significant role. Often parents invest a large amount of money for their daughter's uniform and accessories. Rhinestones and glitter are important to creating a team uniform that stands out to the judges.

Crucial to completing the uniform is the large hair bow. A cheerleader may have a set of expensive hair bows, each one matched to a different uniform.

As a team moves up the ranks in competition events, traveling becomes a frequent necessity. The competitors must bring uniforms, practice clothes, make-up, hairstyling accessories and one or more of these special hair bows.

These hair bows are relatively delicate and finding a way to transport these bows without crushing, wrinkling, tearing, dislodging rhinestones and trim and generally damaging the bows. Traveling with all the necessary clothes and accessories and protecting the hair bows results in many pieces of bulky luggage for just one cheerleader.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a carrying case for transporting a cheerleader's ornamental hair bow. Accordingly, an aspect of an example embodiment in the present disclosure provides a carrying case for transporting an ornamental hair bow in the shape of a hair bow.

Another aspect of an example embodiment in the present disclosure is to provide a complete solution for transporting a cheerleader's ornamental hair bow with a plurality of necessary accessories. Accordingly, the present disclosure provides a pair of compartments, a first compartment for securely transporting the hair bow and a second compartment for transporting a plurality of necessary accessories.

Yet a further aspect of an example embodiment in the present disclosure is to provide a carrying case for transporting a cheerleader's ornamental hair bow that prevents wrinkling and crushing. Accordingly, the present disclosure provides a rigid shell the protects the hair bow from wrinkling and crushing.

Yet a further aspect of an example embodiment in the present disclosure is to provide a carrying case for transporting a cheerleader's ornamental hair bow that prevents wrinkling and crushing. Accordingly, the present disclosure provides a partition in the case having elastic straps, the hair bow secured to the partition during transportation, preventing crushing and wrinkling.

The present disclosure describes a hair bow carrying case for securely transporting a cheerleader's ornamental hair bow, protecting the hair bow from being crushed or wrinkled. The bow is elastically secured in an upper compartment, coupling to a dividing partition. A plurality of necessary accessories for affixing the bow to hair is stored in a lower compartment, the carrying case providing a complete solution for transportation of the bow and the accessories. The carrying case has a rigid shell operative for protecting the delicate bow.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 2:
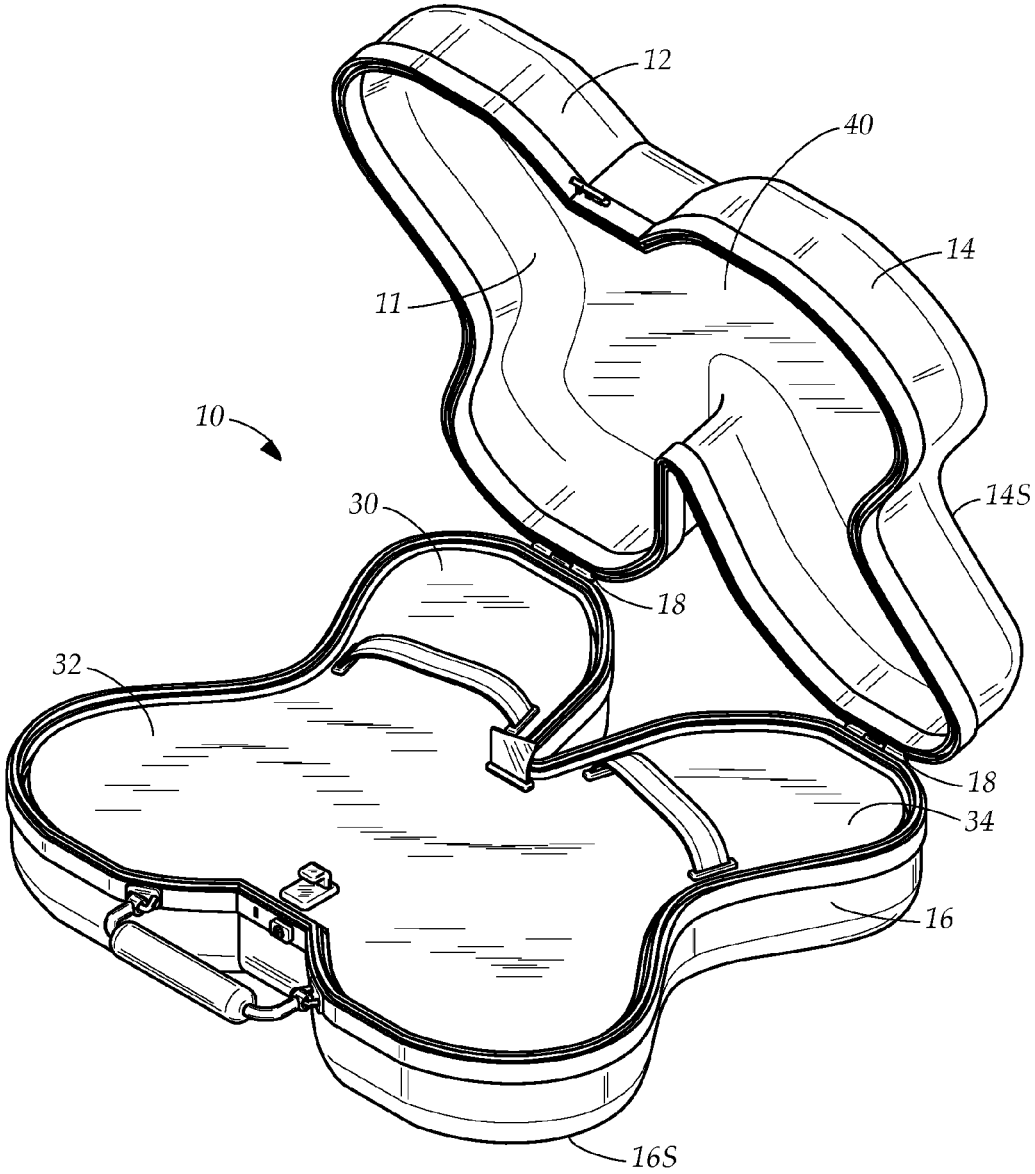
FIG. 2 is a diagrammatic perspective view of the hair bow carrying case with a lid opened showing an upper compartment.

FIG. 2 illustrates a carrying case 10 for an ornamental hair bow, such as the hair bows worn by cheerleaders, particularly during competitions. The hair bows are large, ornate, delicate and considered an essential part of the cheerleading uniform, especially for competitive cheerleading teams. Competitive cheerleading teams travel extensively with their uniforms and accessories. Appearance indirectly in some competitions and directly in others are an important judging criteria and meticulous attention to the uniform's appearance is important, including the crucial hair bow.

The carrying case 10 has a protective rigid outer shell 12 defining an interior volume 11 in a shape of an ornamental hair bow.

A hair bow shape herein is defined as having the shape of hair bow having a pair of loops gathered by a center knot and a pair of ribbon tails radially extending from the center knot.

FIG. 2 illustrates the shell having a pair of members, a first member 14 and a second member 16 hingedly coupled by a pair of hinges 18.

Figure 1:
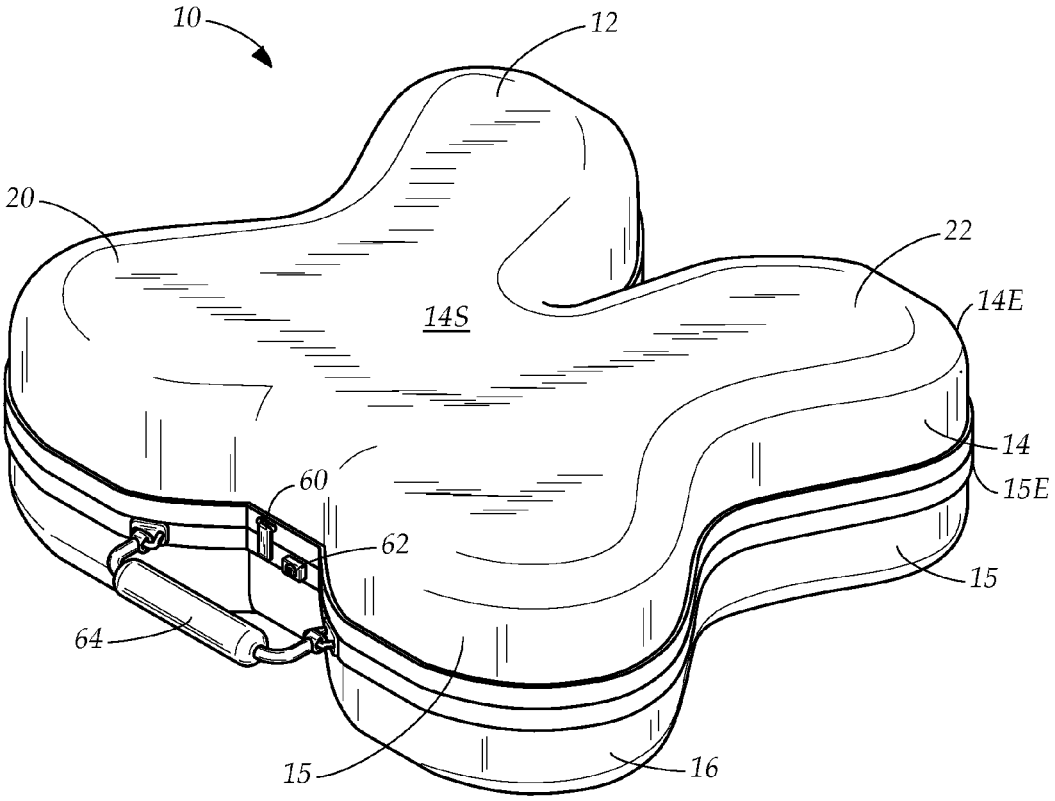
FIG. 1 is diagrammatic perspective view of a hair bow carrying case.

FIG. 1 shows the outer shell 12 of the case 10. The first member 14 and the second member 16 each having a substantially planar surface 14S in the shape of the hair bow.

The planar surfaces have a loop pair portion 20 and a pair of tail portions 22 radially extending from the loop pair portion, emulating the shape of the hair bow defined hereinabove. The planar surfaces have a perimeter edge 14E. It is understood that the edge can be rounded for style purposes and ease of molding.

The members 14, 16 have a plurality of straight sides 15, the sides orthogonally coupled to the edges 14E of the planar surface, the sides of the members outlining the hair bow shape, the sides of the first member a mirror-image of the second member, the sides each having an edge distal 15E from the planar surfaces, the edges of the first member sides abutting the edges of the second member sides when the members are selectively closed, defining the interior volume.

Referring to FIG. 2, the case 10 has a partition 30 in the shape of the ornamental hair bow. The partition is a substantially planar surface having a loop pair portion 32 and a pair of tail 34 portions radially extending from the double loop portion 32. The partition defines a horizontal plane inside the shell 12. The partition bifurcates the interior volume defined by the shell, the partition snuggly fitting inside the shell.

Figure 4:
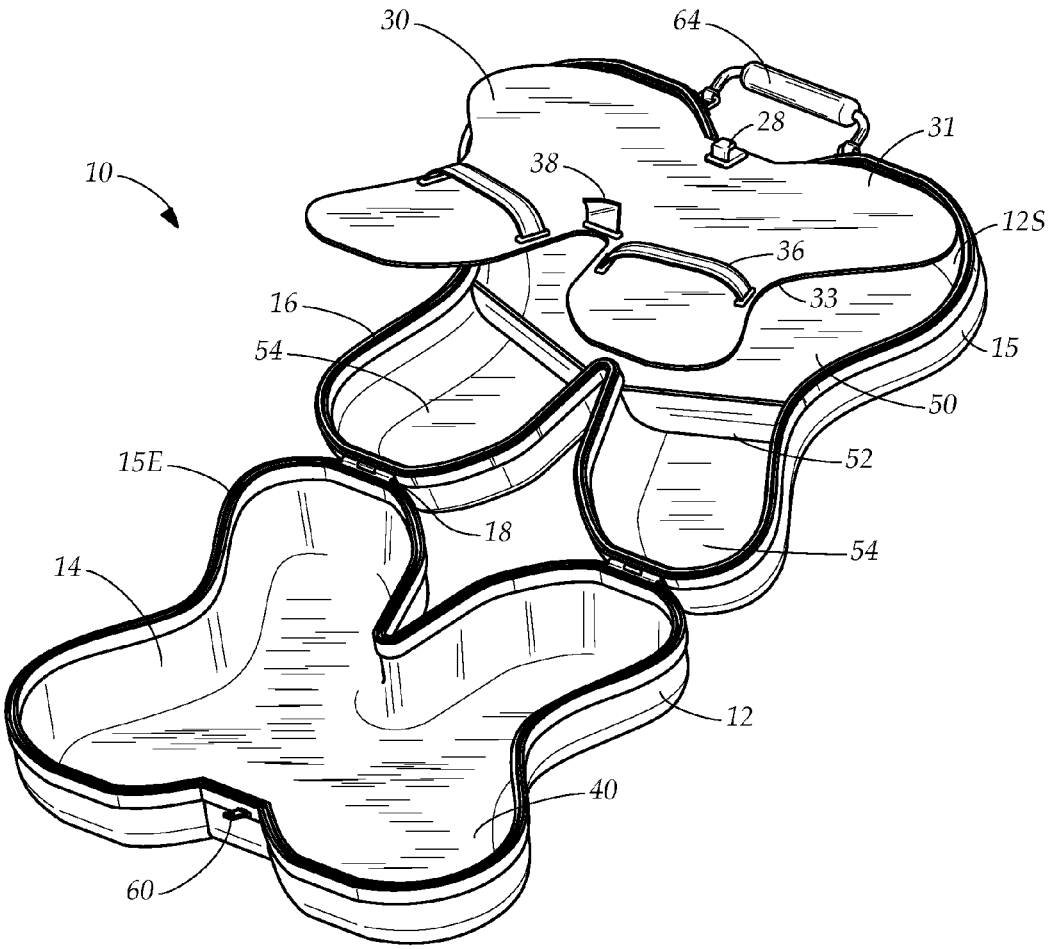
FIG. 4 is a diagrammatic perspective view of the hair bow carrying case with a partition of the upper compartment raised showing a lower compartment.

Referring to FIG. 4, the partition 30 forms a pair of compartments, a first compartment 40 operative for storing the hair bow and a second compartment 50 operative for storing a plurality of accessories for affixing the hair bow on a user.

The partition 30 has a pair of sides, a first side 31 facing the first compartment 40 and a second side 33 facing the second compartment 50.

The partition 30 is hingedly connected to at least one side 15 of the shell 12, the shell having an inside surface 12S and the partition 30 connecting to the inside surface of the second member 16 operative for selectively lifting the partition for accessing the second compartment.

On the first side 31 of the partition 30, there is a pull tab 38 for selectively lifting the snuggly fitting partition for accessing the second compartment 50 and a fastener 28 for securing the hair bow to the partition.

Figure 3:
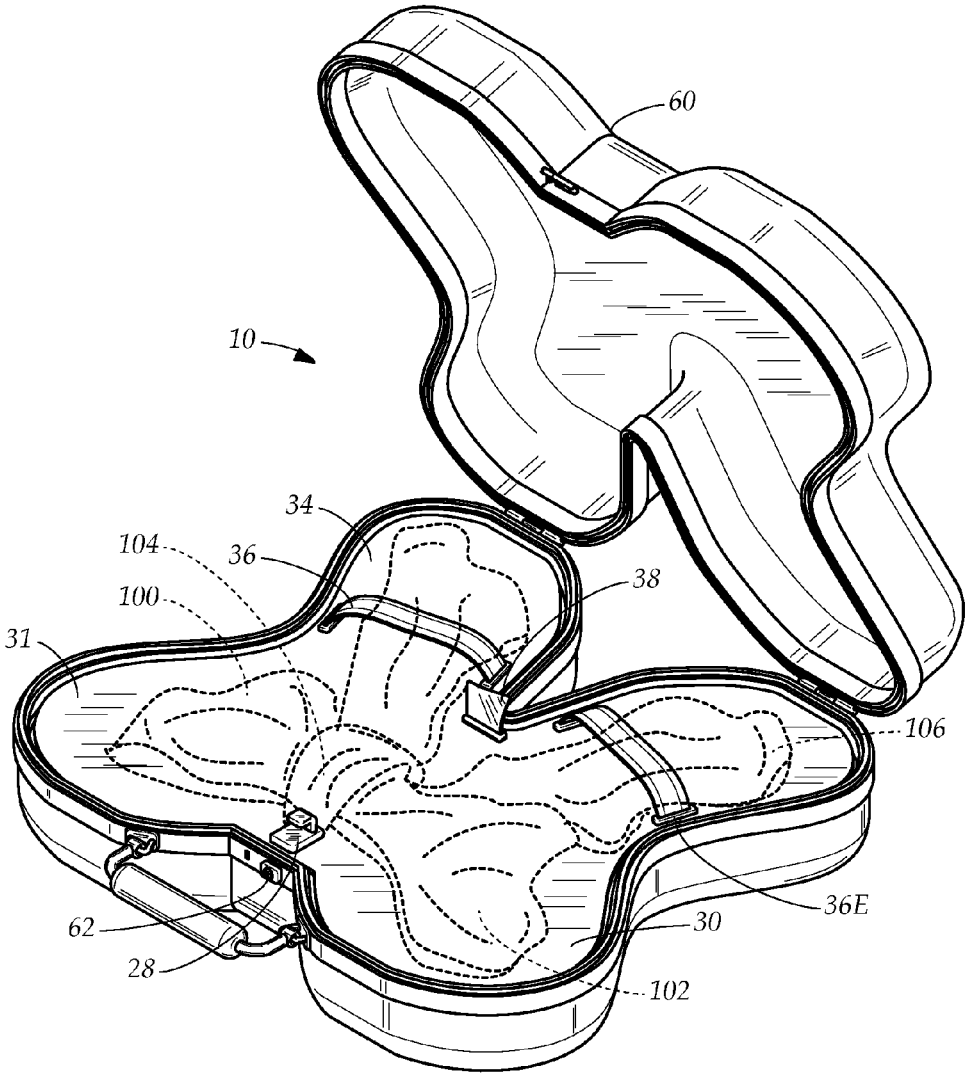
FIG. 3 is a diagrammatic perspective view of the hair bow carrying case showing the upper compartment housing a hair bow.

FIG. 3 shows the hair bow 100 secured inside the case 10. The horizontal partition has a pair of tail portions 34 each having an elastic strap 36. Each strap has a pair of ends 36E coupled to the partition 30, the strap spanning the tail portion, operative for securing the tails 106 of the hair bow 100 to the partition. The straps 36 are on the first side 31 of the partition.

The center knot 104 of the bow is coupled to the fastener 28 and the loops 102 of the bow are supported by the partition 30.

Referring again to FIG. 4, the case 10 has the second compartment 50 that has a plurality of dividers 52 for dividing the second compartment into a plurality of sections 54 operative for storing accessories, such as for example, but not limited to, hair pins, clips, combs, brushes, styling gels and sprays.

In a further embodiment, the sections 54 have lids for keeping the accessories from a first section mixing with accessories in a second section. In yet a further embodiment, the sections include a magnet to keep metal accessories in place. In other embodiments, elastic straps are coupled to the case 10 to hold a plurality of hair styling tools, such as, for example, brushes and combs.

Referring again to FIG. 1, the case 10 has a latch operative for maintaining the members 14, 16 in a closed position is coupled to the sides of the case. The case has a lock 62 for securing the contents and a handle 64 coupled to the shell operative for easy carrying. In a further embodiment, the case has a detachable stand attaching to the planar surface of a member operative for standing the case in an upright position.

Referring to FIG. 4, the method of manufacturing the case 10 includes molding a plurality of members from a material that hardens into a rigid form, the members 40, 50 shaped like a hair bow. Two members are coupled together by a hinge 18, the two members mirror images of each other. The partition 30 is hingedly attached to one member, the member becoming the second member 50 as described hereinabove. Preceding the step of attaching the partition, the fastener 28, the pull tab 38 and the pair of elastic straps 36 are coupled to the partition. The fastener and straps are operative for securing the hair bow to the partition, keeping the hair bow wrinkle-free without being crushed. The partition is placed such that the straps, fastener and tab face the other first member 40 when the members are coupled.

Dividers 52 are placed inside the second member forming a plurality of sections 54 operative for storing accessories.

The handle 64 as well as the latch 60 and lock are added to the case 10.

As shown in FIG. 3, a method of using the case to transport the hair bow is demonstrated. The center knot 104 couples to the fastener 28 and the tails 106 are placed under the elastic straps 36. The pull tab is pulled to lift the partition 30. Accessories are added to the sections in the second compartment and the partition is lowered. The members are selectively closed together, the edges 15E of the members abutting each other. The latch is closed 60 and the case securely locked with the lock 62. The user grabs the handle and has a complete solution for securely transporting her ornamental hair bow, protecting the hair bow from being crushed or wrinkled as well as having all the necessary accessories for properly securing the hair bow to user's hair so that it remains in proper position during the rigorous competition.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a carrying case for a cheerleader's hair bow. The disclosure is illustrated by example in the drawing figures, and throughout the written description. It should be understood that numerous variations are possible, while adhering to the inventive concept. Such variations are contemplated as being a part of the present disclosure.

What is claimed is:

1. A carrying case for an ornamental hair bow, comprising:

a protective rigid outer shell defining an interior volume in a shape of an ornamental hair bow having the shape defined by a pair of loops gathered by a center knot and a pair of ribbon tails radially extending from the center knot, the shell having a pair of members hingedly coupled, the members each having a planar surface in the shape of the hair bow, the planar surface having a loop pair portion and a pair of tail portions radially extending from the loop pair portion, the members having a plurality of straight sides, the sides orthogonally coupled to the edges of the planar surface, the sides of the members outlining the hair bow shape, the sides of the first member a mirror-image of the second member, the sides each having an edge distal from the planar surfaces, the edges of the first member sides abutting the edges of the second member sides when the members are selectively closed, defining the interior volume; and a partition in the shape of the ornamental hair bow, the partition a planar surface having a loop pair portion and a pair of tail portions radially extending from the double loop portion, the partition defining a horizontal plane inside the shell, the partition bifurcating the volume defined by the shell, the partition snuggly fitting inside the shell, the partition forming a pair of compartments, a first compartment operative for storing the hair bow and a second compartment operative for storing a plurality of accessories for affixing the hair bow on a user.

2. The carrying case as described in claim 1, wherein the partition has a pair of sides, a first side facing the first compartment and a second side facing the second compartment.

3. The carrying case as described in claim 2, wherein the partition is hingedly connected to at least one side of the shell, the shell having an inside surface and the partition connecting to the inside surface of the second member operative for selectively lifting the partition for accessing the second compartment.

4. The carrying case as described in claim 3, wherein the partition has a pull tab for selectively lifting the snuggly fitting partition for accessing the second compartment.

5. The carrying case as described in claim 4, wherein the partition has a fastener for securing the hair bow to the partition.

6. The carry case as described in claim 5, wherein the fastener is on the first side of the partition.

7. The carrying case as described in claim 6, wherein the horizontal partition has a pair of tail portions each having an elastic strap, a strap having a pair of ends coupled to the partition, the strap spanning a tail portion, operative for securing the tails of the hair bow to the partition.

8. The carry case as described in claim 7, wherein the straps are on the first side of the partition operative for holding a plurality of hair styling tools.

9. The carrying case as described in claim 8, wherein the second compartment has a plurality of dividers for dividing the second compartment into a plurality of sections operative for storing accessories.

10. The carrying case as described in claim 9, wherein a section in the second compartment has a lid, operative for preventing mixing within the second compartment.

11. The carrying case as described in claim 9, wherein the section in the second compartment has a magnet coupled to the compartment, operative for keeping metal accessories in place.

12. The carrying case as described in claim 9, wherein a latch operative for maintaining the members in a closed position is coupled to the sides of the case.

13. The carrying case as described in claim 12, wherein the carrying case has a handle coupled the shell operative for easy transporting.

14. The carrying case as described in claim 13, wherein the carrying case has a lock.

15. A method of manufacturing a carrying case for transporting an ornamental bow, comprising:

molding a pair of members from a material that hardens into a rigid form having a hair-bow planar shape with edges and sides orthogonally coupled to said edges, outlining the hair bow shape;

coupling the pair of members with at least one hinge forming a shell, a first member and a second member, the members mirror images of each other, the members defining an interior volume when the sides of the first member abut the second member; and attaching a planar partition to a first member, the partition defining a horizontal plane inside the shell and bifurcating the interior volume.

16. The method of manufacturing the carrying case as described in claim 15, further comprises coupling a pull tab, a fastener and a pair of elastic straps to the partition preceding the step of attaching the planar partition to the first member.

17. The method of manufacturing the carrying case as described in claim 16, further comprises attaching a handle, a latch and a lock to the carrying case, the carrying case having an exterior, the handle, latch and lock attaching opposite the at least one hinge.

18. A method of transporting an ornamental hair bow using a carrying case, comprising:

securing a hair bow in a carrying case by coupling a center knot of a hair bow to a fastener, said fastener on a partition in said carrying case, said partition a planar surface in the shape of an ornamental hair bow having a loop portion, a tail portion and a center knot portion joining the loop portion to the tail portion, said fastener at the center knot portion of the partition, said partition bifurcating a horizontal plane inside a rigid outer shell of the carrying case;

placing the tails of the hair bow on said partition, the partition having a pair of elastic straps, said straps securing the tails on the partition when each tail is paced under elastic straps on the tail portion of said partition;

lifting the partition by a pull tab and adding a plurality of accessories into a plurality of compartments thereinbelow before lowering the partition; and latching the carrying case, the carry case having an outer shell with pair of hinged members, each having an edge, the edges of the members abutting when latching, the carrying case having a handle, the user grabbing the handle, providing a complete solution for carrying the hair bow securely without crushing or wrinkling.

19. The method of transporting an ornamental hair bow as described in claim 18, wherein the step of latching the carrying case is followed by the step of locking the carrying case, the carrying case having a lock on the edges of the members.

* * * * *